US010569319B2

(12) United States Patent
Grant et al.

(10) Patent No.: US 10,569,319 B2
(45) Date of Patent: Feb. 25, 2020

(54) DIRECT COUPLED ECCENTRIC DRIVEN PILOT RELEASE STRAIGHTENER

(71) Applicant: Coe Press Equipment Corporation, Sterling Heights, MI (US)

(72) Inventors: Bruce R. Grant, Clarkson, MI (US); Akshai Nakkana, Rochester, MI (US); Ervin Lee Brooks, Clinton Township, MI (US)

( * ) Notice: Subject to any disclaimer, the term of this patent is extended or adjusted under 35 U.S.C. 154(b) by 0 days.

(21) Appl. No.: 15/266,707

(22) Filed: Sep. 15, 2016

(65) Prior Publication Data

US 2017/0072443 A1 Mar. 16, 2017

Related U.S. Application Data

(60) Provisional application No. 62/218,924, filed on Sep. 15, 2015.

(51) Int. Cl.
*B21D 1/02* (2006.01)

(52) U.S. Cl.
CPC ..... *B21D 1/02* (2013.01)

(58) Field of Classification Search
CPC ..... B21D 1/02; B21D 3/02
See application file for complete search history.

(56) References Cited

U.S. PATENT DOCUMENTS

| | | | | |
|---|---|---|---|---|
| 2,256,520 | A * | 9/1941 | Johansen | B21D 1/02 29/81.03 |
| 3,301,031 | A * | 1/1967 | Bearer | B21D 1/02 72/164 |
| 3,701,274 | A * | 10/1972 | Roesch | B21D 1/02 72/165 |
| 3,715,903 | A * | 2/1973 | Huber | B21C 19/00 72/183 |
| 4,107,970 | A * | 8/1978 | Ihle | B21D 1/02 72/165 |
| 4,380,921 | A * | 4/1983 | Matsui | B21D 1/02 72/160 |
| 6,651,476 | B2 * | 11/2003 | Nordlof | B21D 1/02 72/164 |
| 8,250,894 | B2 * | 8/2012 | Yoshioka | B21B 39/02 72/160 |
| 2007/0163321 | A1 * | 7/2007 | Brown | B21D 1/02 72/163 |

* cited by examiner

*Primary Examiner* — Teresa M Ekiert
(74) *Attorney, Agent, or Firm* — John G. Posa; Belzer PC

(57) ABSTRACT

A sheet metal straightener uses a direct coupled eccentric drive for improved pilot release. A motor, coupled to an eccentric bearing, causes connecting arms to reciprocate. At least one of the banks of rollers is coupled to a pivot hinge, and the connecting arms are coupled to a pivoting bank of rollers, causing the pivoting bank to index toward the other bank of rollers in an engaged position for material straightening, and to index away from the other bank of rollers in a relaxed position for pilot release. The pivoting roller bank is preferably a top roller bank positioned above the lower bank. The motor rotates 360 degrees to complete a full cycle, from fully engaged at 0/360 to fully relaxed at 180. The width and degree of roller engagement may be variable to account for different materials and thicknesses.

7 Claims, 4 Drawing Sheets

DIRECT COUPLED ECCENTRIC DRIVEN PILOT RELEASE STRAIGHTENER

REFERENCE TO RELATED APPLICATION

This application claims priority to U.S. Provisional Patent Application Ser. No. 62/218,924, filed Sep. 15, 2015, the entire content of which is incorporated herein by reference.

FIELD OF THE INVENTION

This invention relates generally to metal forming and stamping and, in particular, to a sheet metal straightener with improved pilot release.

BACKGROUND OF THE INVENTION

The metal forming and stamping industries commonly use material handling equipment to process the coil steel through the press. This equipment typically consists of coil reel handlers, threading equipment, feed equipment, and straighteners. Such equipment will handle, unwind, feed and straighten unprocessed coil metal(s) to flatten the material adequately that can then be presented to presses for forming or stamping processes.

Industry known practices utilize common equipment to straighten the presented material utilizing a series of rollers of various diameters, spacing, and width that are sized to match press capacities and metal properties. The aligned rollers, commonly referred to as upper and lower banks, which are located on both the sides of the presented material will apply adequate forces to yield the material greater than the modules of the presented material. The rollers and banks will continue to apply forces to the metal during the feeding phase into the press. As a result, the forces from the rollers (banks) must be relaxed to allow the adjacent press to align and position the straightened material into the press dies allowing proper processing during the press cycle. This is commonly referenced to "pilot release" in the press and stamping industries.

The upper and lower banks of rollers must be actuated or moved out of the way to relax the imposed forces during process. Currently, the process to relax the material in the straightener is commonly achieved utilizing linkages, levers, and cylinders (hydraulic or pneumatic) actuated by motors or cylinders to articulate or reposition the banks at the required interval or timing. The current technologies have limitations related to motion that limits the strokes per minutes (cycle time) and internal mechanical stresses associated with referenced mechanical motions.

SUMMARY OF THE INVENTION

This invention is directed to a sheet metal straightener with improved pilot release operative to relax the material through the use of a direct coupled eccentric drive. The apparatus includes first and second banks of rollers through which sheet material advances for straightening. A motor, coupled to an eccentric bearing, causes connecting arms to reciprocate as the motor turns. At least one of the banks of rollers is coupled to a pivot hinge, and the connecting arms are coupled to the pivoting bank of rollers, causing it to index toward the other bank of rollers in an engaged position for material straightening, and to index away from the other bank of rollers in a relaxed position for pilot release.

The motor may be coupled directly to the eccentric bearing through a drive shaft, for example, to a pair of eccentric bearings through a drive shaft, each eccentric being disposed on an opposing side of the pivoting roller bank. The pivoting roller bank is preferably a top roller bank positioned above the lower bank.

In the preferred embodiment, the motor rotates 360 degrees to complete a full cycle, from fully engaged at 0/360 to fully relaxed at 180. The width and degree of roller engagement may be variable to account for different materials and thicknesses. In a typical working environment, the straightener is configured for operational placement between a roll of coil steel and a stamping die.

DETAILED DESCRIPTION OF THE INVENTION

This invention relates to a system and method to relax the material within a straightener through the use of a direct coupled eccentric drive. This drive relieves roller forces, allowing the material to relax for the press cycle. The drive may comprise various alternative forms of mechanical motion such as a rotary cylinder, electric motor or servo motor, as examples. This technology allows discrete control of the pilot release motion in any radial increment with precise accuracy without the use of linkages or cylinders to generate the required bank displacement.

The invention provides numerous advantages. For one, the technology allows the profile of the coupled eccentric to be altered in infinite variations to maximize the resultant forces and stroke to match any configuration the process demands for optimum performance. The system also decreases the required cycle time while maximizing equipment throughput by responding discretely with the rotational eccentric motion. Utilizing a direct coupled rotation of the eccentric(s), the full rotation of the eccentric prolongs equipment wear and surface contact. Traditional technologies will have reduced lifespan of utilized mechanical components due to side loading and not utilizing the full range of motion.

Figure 1:
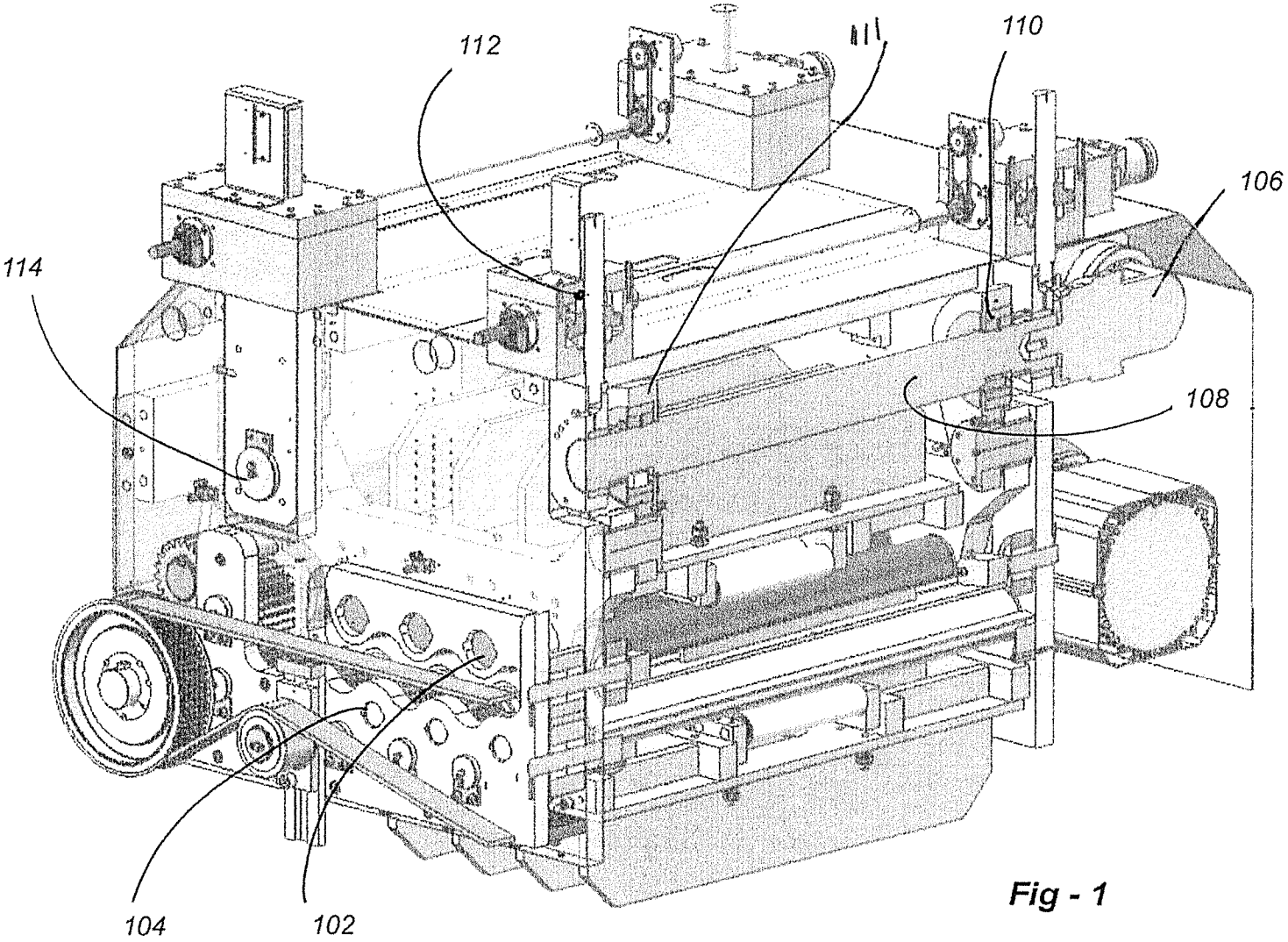
FIG. 1 is an oblique drawing showing a preferred embodiment of the invention.
Figure 2:
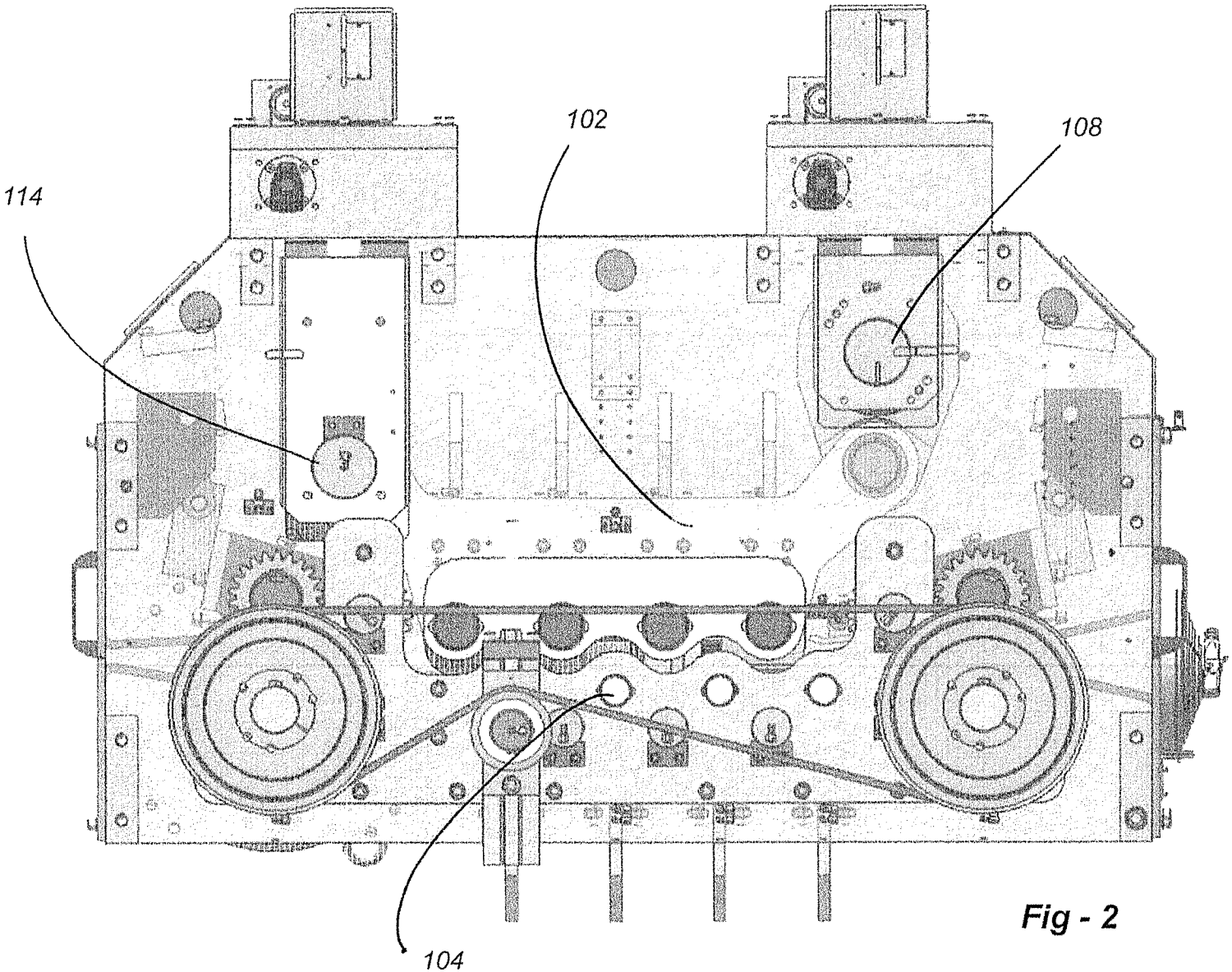
FIG. 2 is a side view with portions removed for the sake of clarity.
Figure 3:
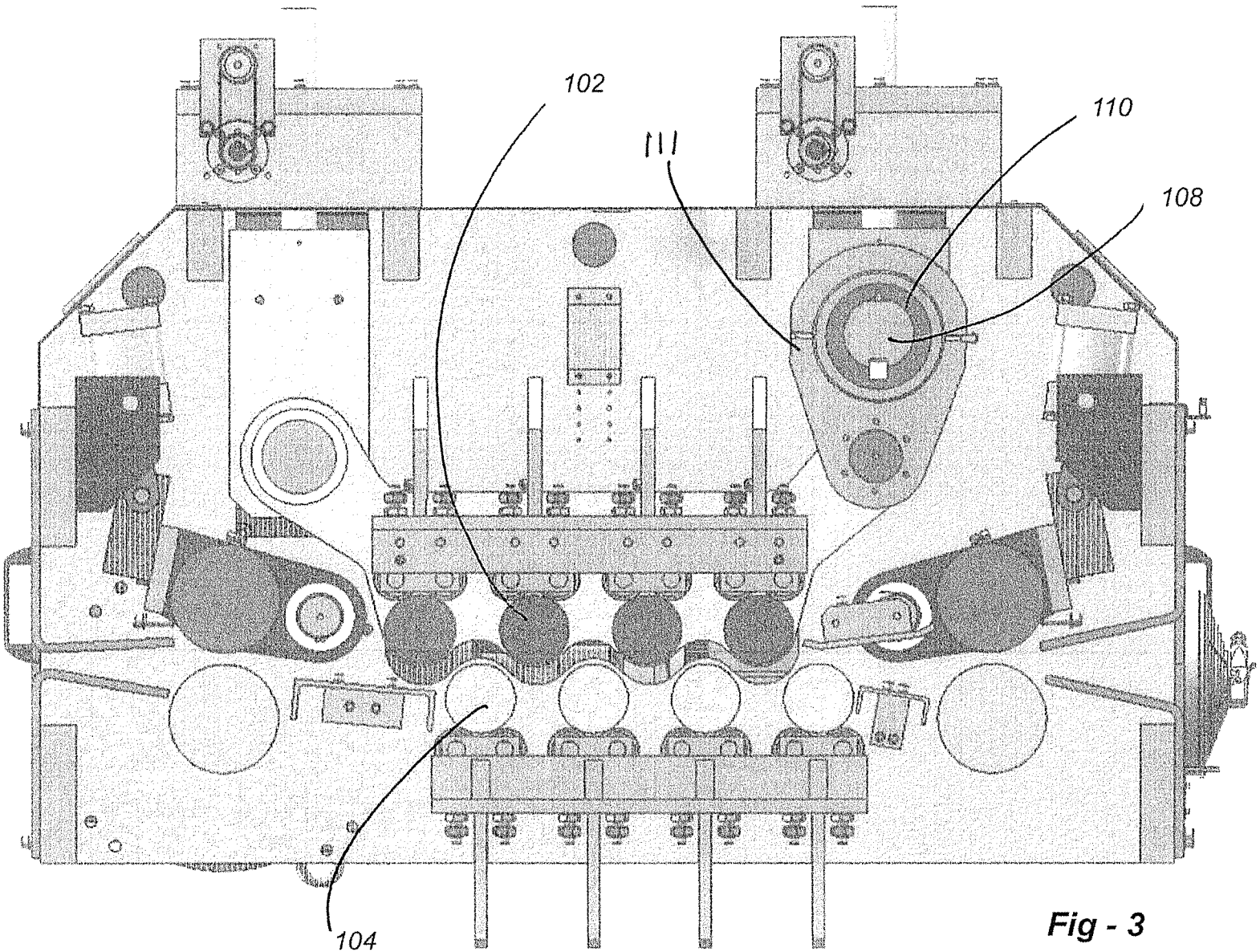
FIG. 3 is a side view with portions removed for clarity.
Figure 4:
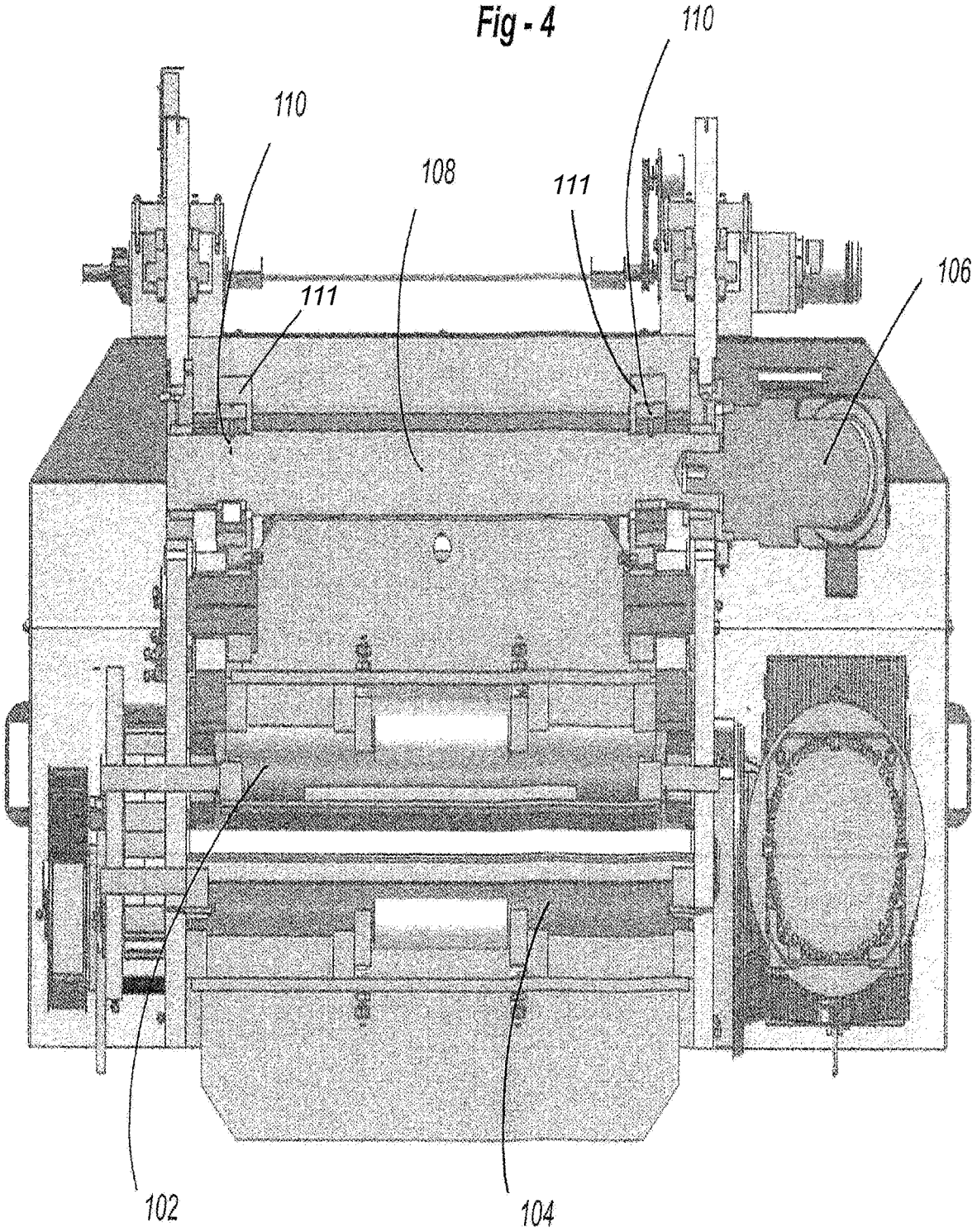
FIG. 4 is an end-on view, in this case the end into which stock material is fed.

FIG. 1 is an oblique drawing showing the preferred embodiment of the invention. FIGS. 2, 3 are side views with portions removed in FIG. 3 for clarity. FIG. 4 is an end-on view, in this case the end into which stock material is fed. Making reference to these drawings, items 102 and 104 are the upper and lower roller banks, respectively. The direct-coupled motor, depicted at 106, turns the eccentric shaft 108. The eccentric shaft 108 rotates within the eccentric bearings 110 which, in turn, causes the connecting arms 111 to index up and down. The connecting arms are connected to the upper bank 102, causing the upper rollers to pivot about pivot hinge 114 between a lower, engaged position wherein the rollers work and straighten the sheet material, and an upper, relaxed position wherein the sheet is freed for pilot release.

In the preferred embodiment, a 360-degree rotation of the motor completes one cycle, from full engagement at 0 degrees, to full relax at 180 and back to full compression at 0/360. The sheet stock is fed from right to left as best seen in the side views of the system. As is common with straightening equipment, the initial rollers at the right are more overlapping, working the material to a greater degree than the exit rollers, the last of which barely contacts the sheet. Note further that the pivot hinge is offset from the roller banks to offer sufficient separation with less movement of the slide block.

While the drawings show a preferred embodiment, many variations are possible without departing from the scope of the invention. The direct coupled eccentric driven pilot mechanism could be installed in multiple configurations to provide increased flexibility for desired mechanical motion. While the drawings show the direct coupled eccentric driven pilot mechanism actuating only one end of the upper bank while pivoting along a fixed hinge, in fact both end of the referenced banks (either upper and/or lower banks) could have the direct coupled eccentric driven pilot mechanism installed allowing independent articulation to each other allowing infinite profiles to be configured allowing the upper and/or lower banks to be positioned relative to the processed material. Nor is the invention limited in terms of width, material thickness, or throughput.

The invention claimed is:

1. A sheet metal straightener with improved pilot release, comprising:

first and second banks of rollers through which sheet material advances for straightening;

a motor coupled to a drive shaft causing the drive shaft to turn;

wherein the drive shaft is coupled to an eccentric bearing;

a connecting arm having first and second ends, and wherein the first end of the connecting arm is coupled to the eccentric bearing causing the connecting arm to reciprocate as the motor turns the drive shaft;

wherein the first bank of rollers is coupled to a pivot hinge; and wherein the connecting arm is coupled to the first bank of rollers, causing the first bank of rollers to pivot toward the second bank of rollers in an engaged position for material straightening, and to pivot away from the second bank of rollers in a relaxed position, disengaged from the material, for pilot release.

2. The straightener of claim 1, wherein the motor is coupled to the eccentric bearing through the drive shaft.

3. The straightener of claim 1, further including a second eccentric bearing coupled to a second connecting arm;

wherein each eccentric bearing and respective connecting arm is disposed on an opposing side of the first banks of roller;

wherein the drive shaft is coupled to the second eccentric bearing; and wherein the motor is coupled to both of the eccentric bearings through the drive shaft.

4. The straightener of claim 1, wherein the first bank of rollers is positioned above the second bank of rollers.

5. The straightener of claim 1, wherein the motor rotates 360 degrees to complete a full cycle, from fully engaged at zero and 360 degrees to fully relaxed at 180 degrees.

6. The straightener of claim 1, wherein the width and degree of roller engagement are variable to account for different materials and thicknesses.

7. The straightener of claim 1, configured for operational placement between a roll of coil steel and a stamping die.

* * * * *